United States Patent [19]

White

[11] 3,962,740

[45] June 15, 1976

[54] SURVIVAL KIT ATTACHMENT FOR A BOAT

[76] Inventor: John W. White, 9 Fairhaven Road, Mattapoisett, Mass. 02739

[22] Filed: Mar. 24, 1975

[21] Appl. No.: 561,269

[52] U.S. Cl. ..... 9/14; 9/3; 9/11 R

[51] Int. Cl.[2] ..... B63C 9/00

[58] Field of Search ..... 9/3, 4 R, 4 A, 1 D, 9/1 C, 14, 11 R, 11 A; 114/68, 123

[56] References Cited

UNITED STATES PATENTS

| | | | |
|---|---|---|---|
| 589,139 | 8/1897 | Raymond | 9/11 R |
| 980,790 | 1/1911 | Johnson | 9/3 |
| 1,226,274 | 5/1917 | Sweeney | 9/11 R |
| 1,383,551 | 7/1921 | Lowndes | 9/3 |
| 3,093,849 | 6/1963 | Iwanitza | 9/14 |
| 3,123,843 | 3/1964 | Tangen | 9/11 R |
| 3,693,573 | 9/1972 | Murphy | 9/1 C |

FOREIGN PATENTS OR APPLICATIONS

| | | | |
|---|---|---|---|
| 115,715 | 8/1942 | Australia | 9/3 |
| 18,394 | 8/1913 | United Kingdom | 9/3 |

*Primary Examiner*—George E. A. Halvosa
*Assistant Examiner*—Charles E. Frankfort
*Attorney, Agent, or Firm*—Salter & Michaelson

[57] ABSTRACT

A survival kit attachment for a boat including a container having an interior chamber formed therein in which survival equipment is stored, one or more of the containers being secured to the underside of the hull of the boat and access to the chamber in the container being provided through a normally sealed opening therein for removal of the survival equipment should the boat capsize or overturn in water, the container further having flotation material located therein; for insuring that the boat will stay afloat in the water if it should capsize.

7 Claims, 6 Drawing Figures

SURVIVAL KIT ATTACHMENT FOR A BOAT

BACKGROUND OF THE INVENTION

The present invention relates to a survival kit attachment for a small boat and to which boat survivors have immediate access in the event of an emergency.

Emergency equipment for use in small boats has usually consisted of flotation pillows that are carried in the boat, and in some instances has included special preservers and other emergency devices such as flares, water and jackets that are also carried in the boat interior for emergency purposes. However, all of the emergency survival kits or equipment as known heretofore, have always been stored in the interior of the boat, either in a locker or some other kind of container or the like that was fixed to the boat interior in the space normally occupied by the boat occupants.

Oftentimes in situations involving emergencies, and in those cases that involved small boats that were overturned in heavy seas, the survival equipment either was not easily accessible, because of the overturning of the boat, or the equipment was lost when the boat capsized. In such instances, the occupants of the boat have usually found themselves in a precarious position, without any accessible survival equipment and without any means for attracting attention to their plight.

SUMMARY OF THE INVENTION

The survival kit attachment as embodied in the present invention comprises a container that is attachable to the bottom outside surface of the hull of a boat and is substantially elongated in configuration, having a pontoon-like construction. A compartment is formed in the container and receives safety equipment, such as flares, food, first-aid packages and the like, and access to this safety equipment is easily obtained through an opening as formed in the compartment when the boat is overturned.

In the event of an emergency situation, wherein the boat to which the safety kit attachment is secured is swamped or capsized, the survivors have immediate access to the safety equipment located within the container as attached to the bottommost portion of the boat hull. The container further provides for maintaining the boat afloat after capsizing, thereby affording additional safety for the boat occupants.

Accordingly, it is an object of the invention to provide a survival kit attachment for boats that is attachable to the hull of the boat and that has safety equipment contained therein that is immediately accessible to the boat occupants should the boat capsize or overturn in water.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
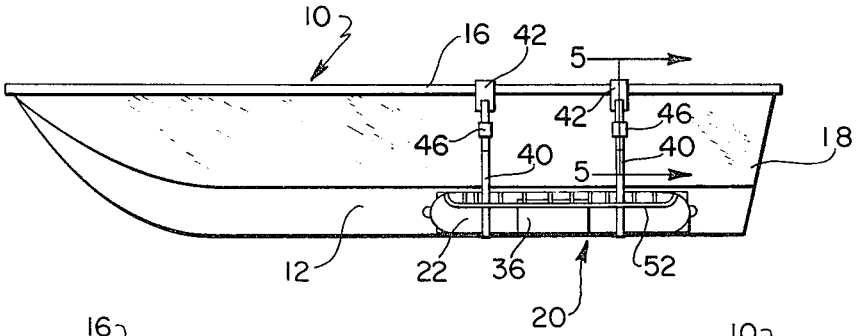
FIG. 1 is a front elevational view of a boat of the small craft variety with the survival kit attachment embodied in the present invention mounted thereon.
Figure 2:
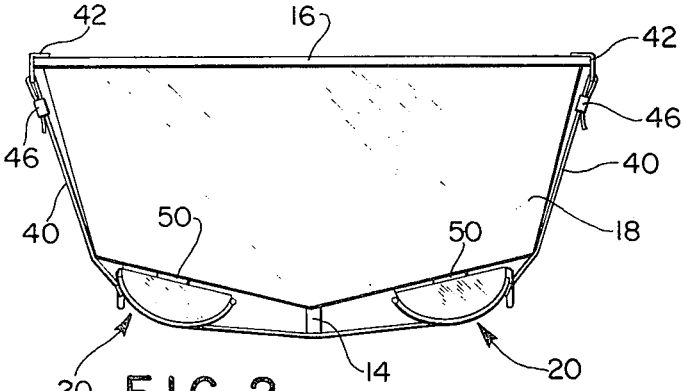
FIG. 2 is a rear elevational view of the boat illustrated in FIG. 1, showing a pair of the attachments mounted on the bottom of the boat hull in symmetrical relation thereon.

Referring now to the drawing and particularly to FIGS. 1 and 2, a conventional boat of the small craft variety is illustrated and is generally indicated at 10. The boat 10 may be of any conventional construction and as illustrated includes a hull 12, the bottommost surface of which is divided at the centerline 14. A gunnel 16 extends around the uppermost edge of the hull 12 in the usual manner; and, as illustrated, the boat 10 is adaptable for use with an outboard motor that would be attachable on the stern 18 of the boat.

Figure 3:
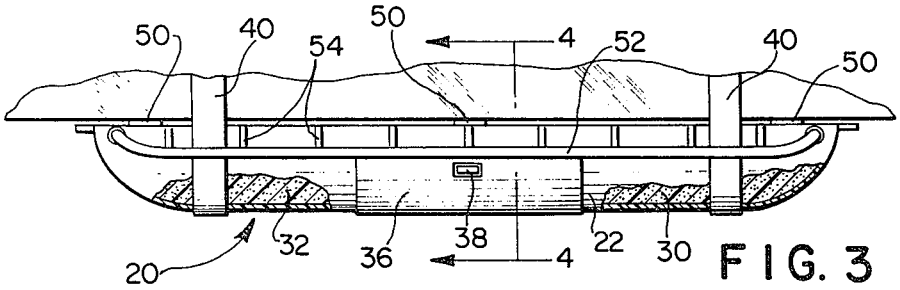
FIG. 3 is an enlarged front elevational view of the survival kit attachment as illustrated in FIG. 1.
Figure 4:
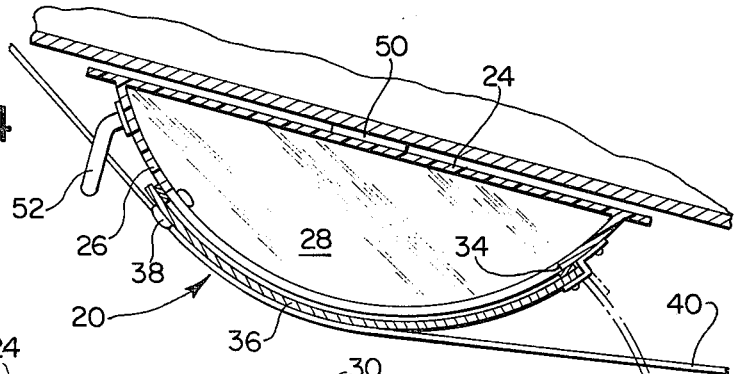
FIG. 4 is a sectional view taken along line 4—4 in FIG. 3.

The survival kit attachment embodied in the present invention is generally indicated at 20, and as illustrated in FIGS. 3 and 4 comprises an elongated hollow container 22 that is defined by a flat bottom wall 24 and a generally curved outer wall 26. Although the container 20 may be formed of any suitable material, it is contemplated that it will be molded of a plastic material in a one-piece construction, plastic being preferred since it is most resistant to water and weather conditions. Formed interiorly of the container 22 is a compartment 28, at the ends of which block portions 30 and 32 are inserted, the block portions 30,32 being formed of a suitable flotation material such as styrofoam, cork or the like. It is seen that the flotation block portions 30 and 32 impart a pontoon effect to the container 20 and, as will be described, aid in maintaining the boat 10 afloat, should it capsize or overturn in water.

An opening 34 is formed in the curved outer wall 26 of the container 20, and a door 36 is pivotally mounted on the wall 26 for engaging the sides of the opening 34 in sealing relation when it is located in the closed position thereof. A convenient handle lock 38 is mounted on the exterior surface of the door 36 and is grasped and turned for unlocking the door 36 and moving it to an open position for exposing the compartment 28.

Figure 5:
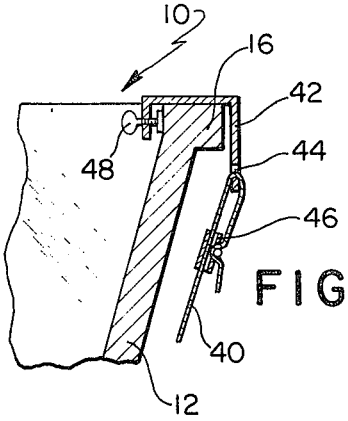
FIG. 5 is a sectional view taken along line 5—5 in FIG. 1.

In order to mount the container 20 on the underside of the hull 12, elongated straps 40 are provided and are secured in surrounding relation with respect to the curved outer wall 26 of the container, the straps 40 being maintained in tensioned relation by attachment to brackets 42 that are mounted on the gunnel 16. As illustrated in FIG. 5, a bracket 42 is provided for each strap 40 and is formed with a slot 44 therein through which an end of a strap 40 extends. A conventional clasp or buckle 46 is mounted on the end of each strap 40 and provides for locking of the straps in tensioned relation around the container 20 and in engagement with the brackets 42. A thumb screw 48 extends through an inner flange portion of each bracket 42 in engagement with the inner wall of the gunnel 16 for mounting the brackets 42 on the gunnel.

As shown in FIGS. 1 and 3, a pair of the straps 40 are provided and are located in spaced relation with respect to the container 20 for securing the container in position. As further illustrated in FIG. 2, when a pair or the containers 20 are mounted on the underside of the hull 12, the straps 40 as employed extend around both of the containers 20, the ends of the straps 40 being tensioned in place by securement to the brackets 42 that are mounted on opposite gunnels of the boat.

In attaching the container 20 to the bottom of the hull 12 by the straps 40, it is necessary to prevent the bottom wall 24 from sliding on the bottom of the hull 12, and for this purpose suction cups 50 are provided and are secured to the rear surface of the wall 24 and are located in contact with the underside of the hull 12.

In the event that the boat 10 overturns or capsizes in water, the containers 20 as secured to the underside of the hull 12 are exposed in the water for access by the survivors. In order to aid the survivors in hanging onto the boat for staying afloat, an elongated hand rail 52 is mounted on the curved outer wall 26 of the container 20 and extends for substantially the length thereof. Intermediate brackets 54 which are secured to the hand rail 52 and to the bottom wall 24 add rigidity to the rail.

Figure 6:
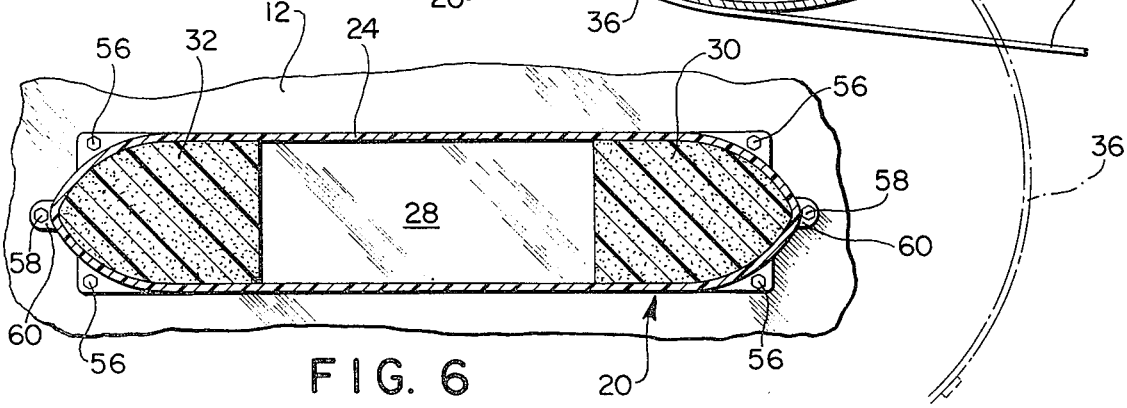
FIG. 6 is a horizontal sectional view taken through the attachment and showing a modified form of securing the attachment to the hull of a boat.

As illustrated in FIG. 6, an alternative form of securing the containers 20 to the underside of the hull 12 of the boat is shown and comprises bolts 56 that extend through flanges joined to the bottom wall 24 of each container. Additional end bolts 58 project through ears 60 as joined to the bottom wall of each container, the bolts 58 cooperating with the bolts 56 to firmly mount the containers on the hull 12. In the event that the bolts 56 and 58 are used to mount the containers 20 on the hull 12, it is seen that the straps 40 and brackets 42 may be eliminated.

In use of the survival kit attachment as illustrated and described herein, the containers 20 are mounted on the underside of the hull 12 by means of the straps 40 or bolts 56 and 58 as described, and with survival equipment stored in the compartments 28 of the containers 20, access thereto is easily available should the boat 10 capsize or overturn. In this event, the occupants of the boat who are thrown into the water, can grip the hand rails 52 for support and then open the door 36 of each container for access to the compartments 28 in which the survival equipment is stored. It is also seen that block portions 30 and 32 of the container 20 which are formed of flotation material, will further aid in maintaining the boat 10 afloat should it overturn or capsize for any reason.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A survival kit attachment for a boat having a hull that defines a botton for said boat, at least one elongated container having an interior chamber formed therein in which survival equipment is stored, means for mounting said container on said hull so that the longitudinal axis of the container is parallel to the longitudinal axis of the boat and the container is disposed on the bottom of the boat exteriorly thereof for complete immersion in water during normal operation of said boat, said container including a generally flat bottom wall located adjacent to said hull in generally parallel relation thereto and further including a generally curved outer wall that extends outwardly of said hull but that offers minimal resistance to the water during movement of the boat therethrough, flotation material located in end portions of said container for assisting in promoting a pontoon effect thereof and insuring that the boat remains afloat upon the capsizing thereof, a chamber formed in said container intermediate the floatation material for receiving said survival equipment therein, an opening formed in said curved wall and communicating with said chamber and equipment stored therein, and a door mounted on said curved wall for sealing said opening when said container is immersed in water as mounted on said hull, said door being movable to an open position to provide access to said chamber and the survival equipment therein when said boat is overturned in water.

2. A survival kit attachment as claimed in claim 1, at least two of said containers mounted on said hull in spaced apart relation thereon.

3. A survival kit attachment as claimed in claim 1, a rail joined to said container and extending substantially the length thereof, said rail defining a hand grip for survivors when said boat is overturned in water.

4. A survival kit attachment as claimed in claim 1, said container having outwardly extending flanges joined thereto, said mounting means including mounting bolts that extend through said flanges and into said hull for permanently fixing said container to said hull.

5. A survival kit attachment as claimed in claim 1, said mounting means including spaced apart straps that extend around the hull of said boat in engagement with said container, said straps being fixed to said boat for mounting said container on the hull thereof.

6. A survival kit attachment as claimed in claim 5, brackets removably mounted on the gunnels of said boat for fixing said straps to said boat.

7. A survival kit attachment as claimed in claim 6, suction members secured to an exterior wall of said container and engaging the hull of said boat for assisting said straps in fixing said container to said hull.

* * * * *